US005320571A

United States Patent [19]

Lo

[11] Patent Number: 5,320,571

[45] Date of Patent: Jun. 14, 1994

[54] DUMMY FOR USE AS SHAM PASSENGER IN CAR

[76] Inventor: Hsin-Hsin Lo, 9, Slley 3, Lane 35, Weitao Rd., N. Dis. Taichung, Taiwan, Taiwan

[21] Appl. No.: 35,200

[22] Filed: Mar. 22, 1993

[51] Int. Cl.[5] ..... G09F 19/08; A63H 11/00

[52] U.S. Cl. ..... 446/178; 446/201; 446/353; 40/412; 40/538

[58] Field of Search ..... 446/178, 198, 199, 201, 446/353; 40/411, 414, 423, 593, 412, 422, 477, 429, 439, 440, 538

[56] References Cited

U.S. PATENT DOCUMENTS

| | | | |
|---|---|---|---|
| 2,091,670 | 8/1937 | Budd | 40/422 X |
| 3,973,771 | 8/1976 | Schuman | 40/440 X |

FOREIGN PATENT DOCUMENTS

| | | | |
|---|---|---|---|
| 78950 | 3/1955 | Denmark | 446/201 |
| 225318 | 12/1924 | United Kingdom | 446/201 |
| 410223 | 5/1934 | United Kingdom | 446/353 |

*Primary Examiner*—Danton D. DeMille
*Attorney, Agent, or Firm*—Larson and Taylor

[57] ABSTRACT

A dummy for use as a sham passenger can be fastened to the passenger side of the front seat of a car by means of a safety belt, The dummy can be properly dressed and furnished with a wig. In addition, the dummy is provided with a driving device and a circuit, which are capable of causing the dummy to move in a manner that it appears to be talking to the driver or looking out through the car window located by the passenger side of the front seat. The dummy is used as an effective means to deter an assault made on a lone driver and to give the lone driver a timely sense of security as well as peace of mind.

4 Claims, 2 Drawing Sheets

DUMMY FOR USE AS SHAM PASSENGER IN CAR

BACKGROUND OF THE INVENTION

The present invention relates to a dummy for use as a sham passenger in a car.

An automobile has become an indispensable means of transportation in a modern society. As people are driving more often than ever, various problems associated with the driving have surfaced inevitably. We have often read the reports in the newspapers and the magazines on such incidents that persons who drove alone without an accompanying passenger were assaulted, or robbed, or molested sexually. Such incidents often take place in a remote and sparsely-populated area, especially at night. A lone female driver is especially vulnerable to an assault.

SUMMARY OF THE INVENTION

It is therefore the primary objective of the present invention to provide a dummy, which is used as a sham passenger in a car to discourage an assault of any nature made on a person who drives alone without an accompanying passenger. In addition, such dummy serves the purpose of affording a lone driver, especially a lone female driver, a sense of security.

In keeping with the principle of the present invention, the foregoing objective of the present invention is attained by a dummy which can be fastened to the passenger side of the front seat of a car by means of a safety belt. The dummy can be properly dressed and furnished with a wig. In addition, the dummy is provided with a driving gear and a circuit, which are capable of causing the dummy to move in a manner that it appears to be talking to the driver or looking out through the car window occasionally. In addition to serving as a deterrent to an assault made on a lone driver, the dummy affords the lone driver a sense of security.

The foregoing objective, structures, functions and features of the present invention will be better understood by studying the following detailed description of a preferred embidiment of the present invention, in conjunction with the drawings provided herewith.

DETAILED DESCRIPTION OF THE PREFERRED EMBODIMENT

Figure 1:
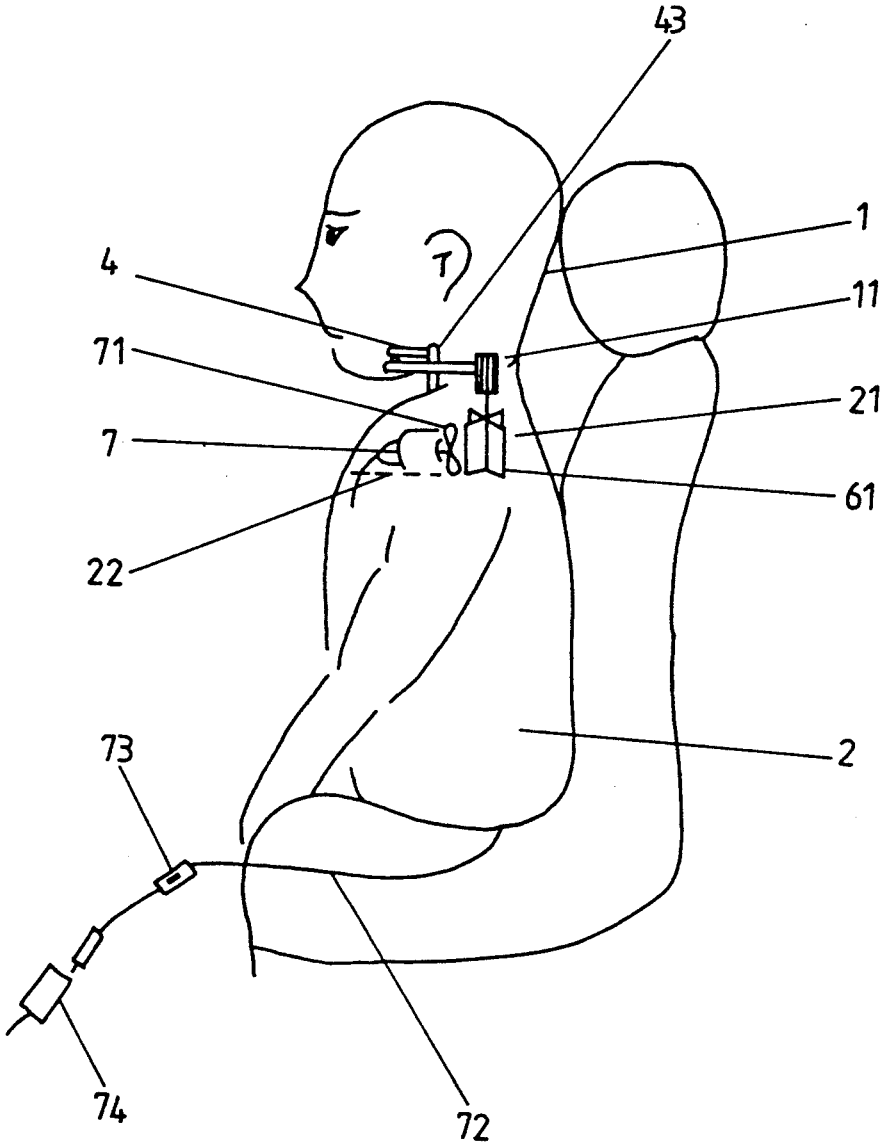
FIG. 1 shows a sectional schematic view of a dummy in combination, according to the present invention.
Figure 2:
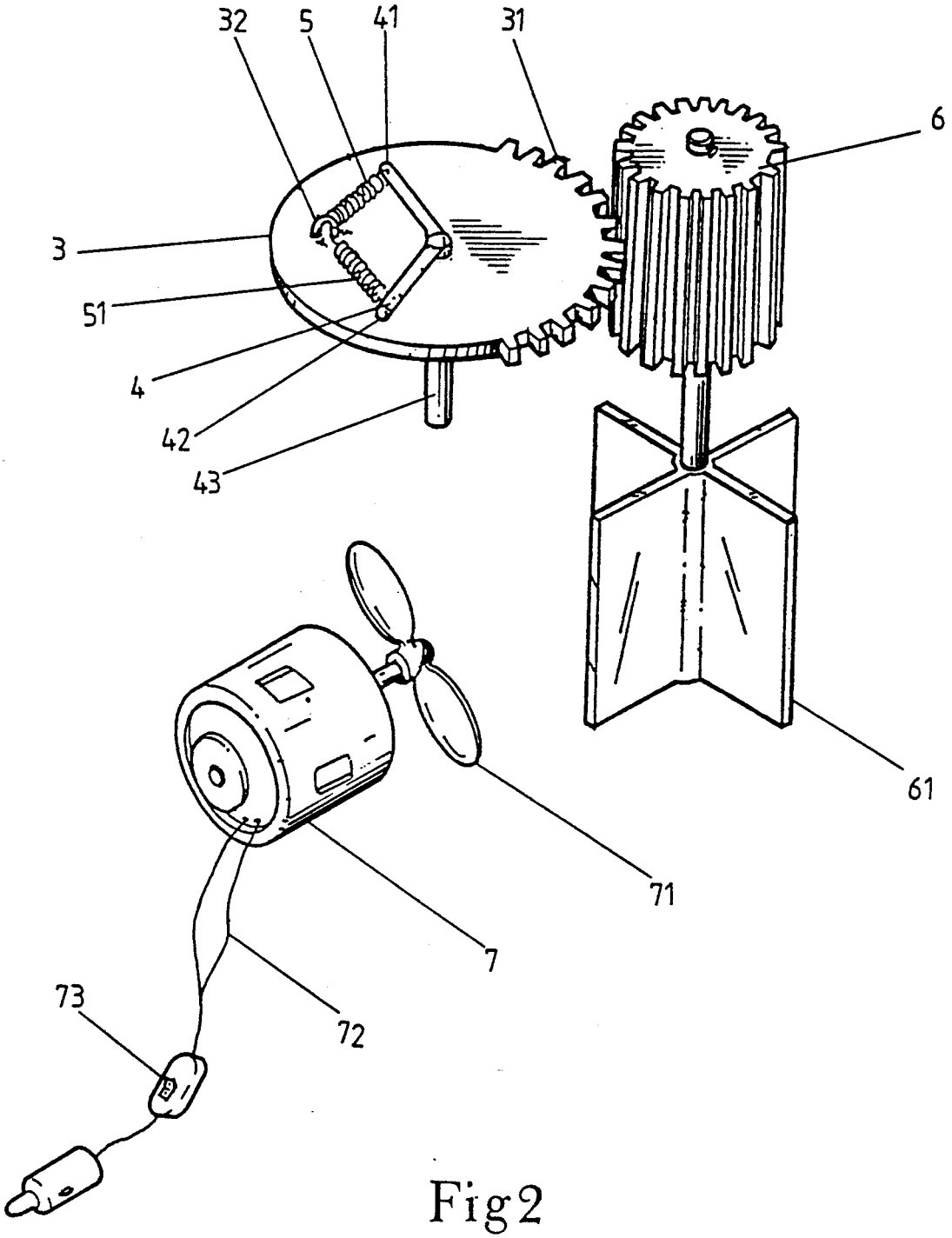
FIG. 2 shows an exploded view of a driving device of the dummy of the present invention.

Referring to FIGS. 1 and 2, a dummy 2 embodied in the present invention is shown to comprise a head 1 and a neck 11 which contains therein a retaining disk 3 provided with a serrated portion 31. The retaining disk 3 is further provided with a connection rod 4 of a V-shaped construction, which is coupled with one end of a support rod 43 arranged perpendicularly to the underside of the retaining disk 3. The V-shaped connection rod 4 has two ends 41 and 42, which are coupled respectively with springs 5 and 51. The springs 5 and 51 are fastened securely to a fastening ring 32 mounted securely on the retaining disk 3. There is a pinion 6 which is arranged in a manner that it meshes with the serrated portion 31 of the retaining disk 3. The bottom end of the shaft of the pinion 6 is provided with a rotating piece 61, which extends into the chest 21 of the dummy 2. The chest 21 contains therein a motor mount 22 corresponding in location to the rotating piece 61. Mounted on the motor mount 22 is a motor 7 with a fan 71 attached thereto. The motor 7 is in communication with a switch 73 via a power source line 72. The switch 73 is coupled with a jack 74.

The head 1 of the dummy 2 can be furnished with an appropriate wig. In addition, the dummy 2 may be dressed properly and provided with a rubber skin of an appropriate color, so that the dummy 2 looks like a genuine human figure.

The dummy 2 is seated on the passenger side of the front seat of a car and is fastened with a safety belt. The jack 74 is placed at the cigarette lighter in the car. When the switch 73 is turned on, the motor 7 drives the fan 71 to agitate the air. The air flow forces the rotating piece 61 to swivel so as to activate the pinion 6 to turn. The rotation of the pinion 6, which meshes with the serrated portion 31 of the retaining disk 3, cause the retaining disk 3 to turn. The rotation of the retaining disk 3 causes the head 1 of the dummy 2 to sway. Upon having swayed for a predetermined angle, the head 1 begins turning back to its initial position by virtue of the fact that the rotation of the serrated portion 31 of the retaining disk 3 is confined to a limited range corresponding to the range of the serrated portion 31. As soon as the rotation of the serrated portion 31 has reached its limit, the elastic force of the spring 51 causes the retaining disk 3 to turn in a counter-clock-wise direction, thereby making the head 1 to turn horizontally in a direction toward the car window situated by the passenger side of the front seat. In a similar manner, the elastic force of the spring 5 causes the head 1 of the dummy 2 to turn in a direction toward the driver, thereby making the dummy 2 appear to be talking to the driver.

Therefore, the dummy 2 of the present invention can be used as affective means to deter an assault made on a lone driver and to give the driver a timely sense of security as well as peace of mind.

The dummy of the present invention is of a hollow construction and is therefore light in weight. When not in use, the dummy 2 of the present invention can be kept easily in the car trunk, without taking up too much of the space in the trunk.

What is claimed is:

1. A dummy for use as a sham passenger in a car, comprising: a head, limbs, and a trunk; wherein said trunk comprises a neck containing therein a retaining disk provided with a serrated portion, a V-shaped connection rod having a support rod attached thereto in a manner such that said support rod passes freely through the retaining disk and is substantially perpendicular to an underside of said retaining disk, said connection rod having two ends, each of which is fastened to one end of a biasing means having another end that is fastened to a fastening ring which is attached to the retaining disk, said serrated portion of said retaining disk being so arranged as to mesh with a pinion having a shaft coupled with a rotating piece extending into a chest of said trunk of said dummy, said chest further containing a motor with a fan attached thereto and with a power switch connected thereto; wherein said retaining disk extends into said head and rotation of said retaining disk causes said head to move; and wherein said head, said limbs and said trunk are of an appropriate color to represent a person.

2. A dummy as recited in claim 1, wherein said trunk and said limbs are furnished with clothing.

3. A dummy as recited in claim 1, wherein said head is furnished with a wig.

4. A dummy as recited in claim 1, wherein said switch is coupled with a jack to be placed in a cigarette lighter of an automobile.

* * * * *